United States Patent [19]

Frentzel-Beyme

[11] Patent Number: 4,928,463

[45] Date of Patent: May 29, 1990

[54] YARN BRAKE MECHANISM FOR A TWO-FOR-ONE TEXTILE YARN TWISTING MACHINE SPINDLE ASSEMBLY

[75] Inventor: Johannes Frentzel-Beyme, Mönchen-Gladbach, Fed. Rep. of Germany

[73] Assignee: Palitex Project Company GmbH, Krefeld, Fed. Rep. of Germany

[21] Appl. No.: 246,879

[22] Filed: Sep. 20, 1988

[30] Foreign Application Priority Data

Sep. 30, 1987 [DE] Fed. Rep. of Germany ..... 3732904

[51] Int. Cl.[5] ..... D01H 7/86; D01H 13/10; B65H 59/06; B65H 59/36

[52] U.S. Cl. ..... 57/58.86; 57/58.52; 57/58.83; 242/147 R; 242/149

[58] Field of Search ..... 57/58.49, 58.52, 58.83–58.86; 242/147 R, 149–152.1, 47.01

[56] References Cited

U.S. PATENT DOCUMENTS

| | | | |
|---|---|---|---|
| 2,733,566 | 2/1956 | Vibber | 57/58.86 |
| 3,177,643 | 4/1965 | De Halleux et al. | 57/58.86 |
| 3,445,998 | 5/1969 | Nakahara et al. | 57/58.84 |
| 3,742,693 | 7/1973 | Greive et al. | 57/58.52 X |
| 4,338,774 | 7/1982 | Welters | 57/58.86 |
| 4,363,207 | 12/1982 | Fukunaga | 57/58.86 |
| 4,423,587 | 1/1984 | Inoue | 57/58.86 |
| 4,434,609 | 3/1984 | Schacht | 57/58.86 |

FOREIGN PATENT DOCUMENTS

| | | |
|---|---|---|
| 563593 | 11/1932 | Fed. Rep. of Germany . |
| 1170290 | 12/1964 | Fed. Rep. of Germany . |
| 2128485 | 12/1972 | Fed. Rep. of Germany . |

*Primary Examiner*—John Petrakes

*Attorney, Agent, or Firm*—Bell, Seltzer, Park & Gibson

[57] ABSTRACT

A two-for-one twisting spindle, onto the feed bobbin carrier of which may be slipped concentrically at least two feed bobbins axially one above the other, from which bobbins the yarns are drawn off overhead and commonly enter the yarn inlet tube, onto which is slipped a braking device which has a slip-on member and a brake ring carried thereby, characterized in that the slip-on member is mounted on the yarn inlet tube by means of a bearing so as to be easily rotatable.

14 Claims, 2 Drawing Sheets

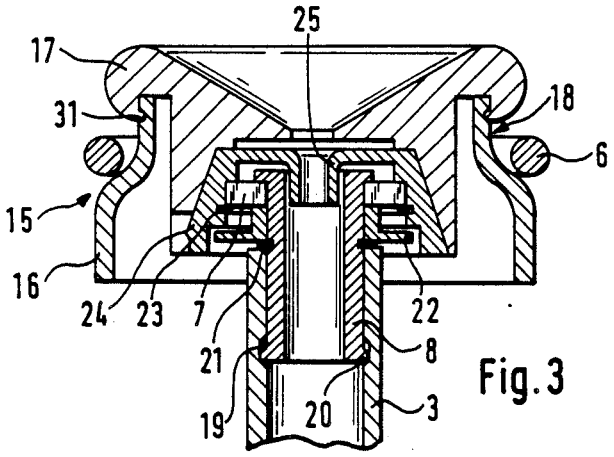
Fig. 3
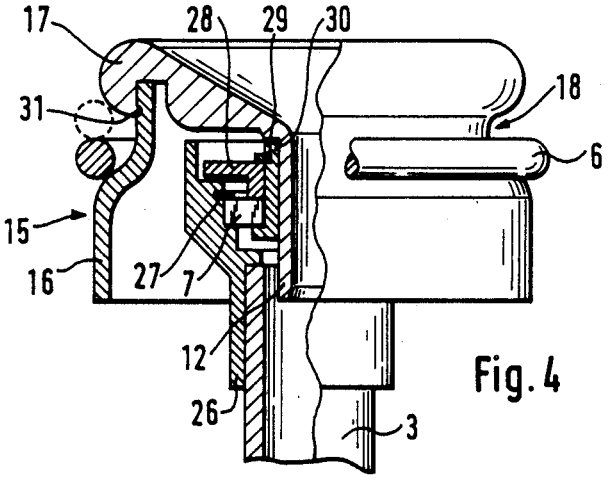
Fig. 4
Fig. 5
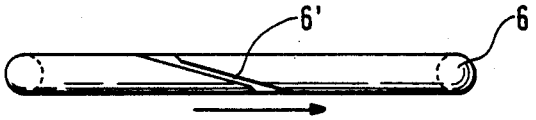
Fig. 6
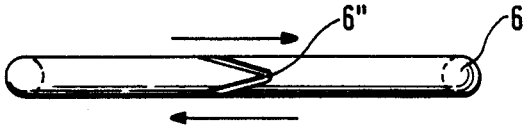

YARN BRAKE MECHANISM FOR A TWO-FOR-ONE TEXTILE YARN TWISTING MACHINE SPINDLE ASSEMBLY

FIELD OF THE INVENTION

The invention relates to a two-for-one textile yarn twisting machine spindle assembly having a yarn brake mechanism for applying substantially uniform tension to the yarns moving from supply packages to a yarn inlet tube without one yarn affecting the tension on the other yarn.

BACKGROUND AND OBJECTS OF THE INVENTION

Difficulties can occur in the yarn supply in two-for-one twisting spindles or in bobbin creels if threads are drawn off from at least two feed bobbins, which are slipped one on top of the other, and are fed to the machining device. For example, yarns are drawn off from two single-winding cross-wound bobbins, which are slipped one on top of the other and are fed, for example, to the yarn inlet tube of a two-for-one twisting spindle. A brake ring or floating ring, which is disclosed in German Patent Specification No. 563 593 and which is slipped onto the yarn inlet tube, can be used for such a yarn supply. This brake ring or floating ring is a simple, smooth ring beneath which either the yarns from the two feed bobbins, or the top yarn only, are guided on the way to the top of the yarn inlet tube, so that the brake ring is lifted by the yarns entering the spindle such that it is suspended and its weight tensions the yarn.

The yarn entry of two yarns, taken for example from single-winding cross-wound bobbins, does not correspond to the yarn entry of a doubled yarn, which enters the area of the brake ring or floating ring as a single yarn and lifts the ring in a defined manner at one point.

The two yarns coming from single-winding cross-wound bobbins are independent of one another and enter the brake ring zone with different yarn tensions. This can be caused, for example, by the different diameters of the two run-off or feed bobbins. Irregular yarn entry may also be caused by the taper of the bobbin or by the crossing angle. When two or more separate yarns enter the zone of the brake ring, the yarn with the higher entry tension will lift the brake ring or floating ring. A gap is thus formed on a section between the brake and its bearing face, which gap is larger than the average gap dependent upon the yarn thickness. The second yarn may, by chance, enter the resulting space or gap and is thus not braked like the yarn having the higher entry tension, which has lifted the brake ring.

As a result, a loop may be formed, particularly in the case of high-twist spun yarn.

In order to obtain uniform braking of the individual yarns, which enter independently from one another, without the yarns affecting one another, and to even out the tensions of the individually supplied yarns, a braking device, which is described in German Patent Specification No 31 24 482 corresponding to U.S. Pat. No. 4,434,609, and which is for use in a two-for-one twisting spindle and has a slip-on member and a brake ring mounted thereon, is designed in such a way that the brake ring is provided in the manner of a comb with teeth, which extend inwardly and obliquely upwardly and are inclined in the same direction in the peripheral direction of the delivered yarns, at least two of which overlap along each generatrix line of the slip-on member, wherein the part of the slip-on member accommodating the brake ring is conical and the upper side of the slip-on member is defined by an annular shoulder which projects radially outwardly and has a rounded edge, thereby forming a groove.

By using a comb-like ring as a braking member, which is known from other textile machines, in conjunction with a specially formed counter-member or slip-on member, the individual yarns are braked without the tension of one yarn influencing the tension of the other yarn during the braking operation.

It is the object of the invention to design a braking device, in particular for a two-for-one twisting spindle, in which at least two yarns are drawn off simultaneously and separately from one another from at least two feed bobbins, in such a way that the independently supplied individual yarns are braked evenly, without being affected by another yarn, in order to achieve an evening out of the yarn tensions of the individual yarns without using a comb-like brake ring.

This object is achieved by an improved yarn brake mechanism including a slip-on member including bearing means for being rotatably mounted on the upper end portion of the yarn inlet tube for rotation relative thereto. The slip-on member comprises a rotationally symmetrical member having a necked-down portion. A brake ring is floatingly received and mounted in the necked-down portion on the slip-on member and receives the separate yarns between the brake ring and the slip-on member as the yarns move from the supply packages to the yarn inlet tube for applying desired tension to the yarns. As a result of the rotation of the slip-on member caused by the friction forces of the yarn, the rotational speed of the slip-on member is commensurate with the rotational speed of the yarns being delivered by the bobbin, which ensures that the yarns are handled carefully.

Slip-on members or inlet heads which are freely rotating and which are carried along by the yarn are already known, for example from German Patent Specification No. 1 170 290. This entry head has, however, at least one yarn guide slot, so that it is not possible for the yarn to slide in the peripheral direction of the inlet head. However, such enforced guiding of a yarn is not admissible when two yarns, which are delivered from two feed bobbins, are supplied separately.

BRIEF DESCRIPTION OF THE DRAWINGS

The invention is further described below with reference to the drawings, in which:

FIG. 3 is a further embodiment of the braking device according to the invention;

FIG. 4 is yet another embodiment of the braking device according to the invention;

FIG. 5 is a side view of a brake ring; and

FIG. 6 is a side view of a different embodiment of a brake ring.

DETAILED DESCRIPTION OF PREFERRED EMBODIMENTS OF THE INVENTION

Figure 1:
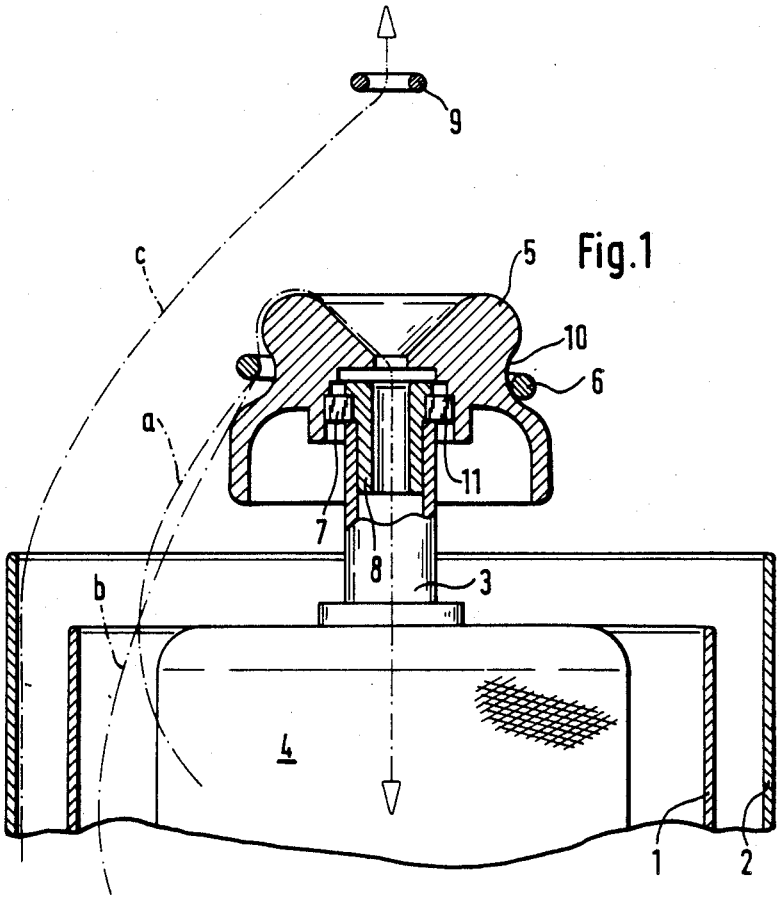
FIG. 1 is a schematic representation of the upper part of a two-for-one twisting spindle.

FIG. 1 shows a protection pot 1, a balloon limiter 2 and a yarn inlet tube 3 of a two-for-one twisting spindle, on whose feed bobbin carrier two or more run-off bobbins 4 are slipped. A rotationally symmetrical slip-on member 5 is freely rotatably mounted on the yarn inlet tube by means of a bearing 7. The slip-on member 5 is provided with a central inlet opening, which is concentric with respect to the axis of the yarn inlet tube 3. The slip-on member 5 is provided with a circumferentially extending necked-down portion 10 for the floating reception of the brake ring 6. The radius of the bearing 7 is as small as possible in order to permit rotatable mounting of the slip-on member 5, that is, if a ball bearing or roller bearing is used, the rolling radius is as small as possible. The slip-on member 5 may also be mounted by means of a sliding bearing, in which case materials are used which have particularly good sliding properties.

In the embodiment shown in FIG. 1, a holding ring 8, onto which the bearing 7 is slipped, is inserted into the yarn inlet tube, the slip-on member 5 being pushed onto the bearing 7 and supported by an annular shoulder 11.

Figure 2:
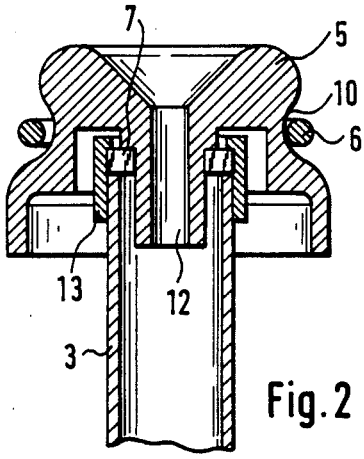
FIG. 2 is a variant of a braking device.

In the embodiment shown in FIG. 2, the bearing 7 is mounted on the yarn inlet tube 3 by means of a sleeve 13, which has an inwardly drawn flange. The slip-on member 5 is provided with a central tube piece 12, which is inserted into the bearing 7 mounted on the yarn inlet tube 3.

The yarns a and b drawn off from the upper bobbin 4 and the lower bobbin (not shown) are guided between the slip-on member 5 and the brake ring 6 and through the central opening of the slip-on member 5 into the yarn inlet tube 3. The yarns a and b, which are supplied separately, leave the hollow axle of the spindle in the conventional way in the region of the yarn reserve disc in the tangential direction and, already twisted, they continue upwards in a known manner, forming a yarn balloon c, up to a yarn guide eye 9, which determines the top of the yarn block.

According to FIGS. 3 and 4, the slip-on member 15 comprises two rotationally symmetrical parts 16 and 17, which are detachable from one another in the axial direction. The lower part 16 of the slip-on member has substantially two annular portions of different diameter, which are connected to one another by a rounded shoulder portion, the upper free edge region of the annular portion having the smaller diameter being provided with a circumferential groove, into which a circumferential rib 31 of the upper part 17 of the slip-on member engages. The two parts 16 and 17 can thus substantially be snapped together, wherein at least one of the two parts is to a certain extent elastic. In this way, by separating the two parts 16 and 17, it is possible to remove a closed brake ring 6 in a simple way and to replace it if necessary by a new brake ring 6.

The closed brake ring 6 may be replaced by a slotted brake ring 6 as shown in FIGS. 5 and 6. In the embodiment shown in FIGS. 5, the brake ring 6 has a threading slot 6' which, when viewed from the side, runs obliquely from the upper side of the ring to the lower side thereof. Such a slotted brake ring 6 allows the thread to be threaded, such a brake ring being provided for one circumferential direction of the thread.

According to the embodiment in FIG. 7, the brake ring 6 has a threading slot 6'', which is V-shaped when viewed from the side, the point of the V lying in the centre plane of the ring. Such a brake ring allows the threads to run to the right and to the left.

Brake rings according to the prior art are used primarily in filament yarns, in which a yarn passes between the brake ring and the slip-on member. In the present case, however, two yarns, coming from different bobbins, enter the gap between the slip-on member and the brake ring. Because two individual yarns are entering this gap, it must be ensured that they do not get caught between the brake ring and the slip-on member. The best conditions for two yarns passing between the brake ring and the slip-on member are obtained in accordance with the invention if the largest outer diameter of the part of the slip-on member 5, 15 above the brake ring 6 is approximately 10 to 20% larger than the inner diameter of the brake ring 6.

FIGS. 3 and 4 show slip-on members 15, which can be removed from their bearings. This is necessary if the inner diameter of the sleeve of the run-off bobbins 4 is smaller than the outer diameter of the slip-on member 15, including the brake ring 6.

In FIG. 3, a holding ring 8 is inserted into the upper end of the yarn inlet tube 3 and is prevented from being removed from the yarn inlet tube by means of an annular groove 19 and in the yarn inlet tube 3 and an annular projection 20, which is mounted on its lower end and projects outwardly. The holding ring 8 is supported by means of a snap ring 21 on the upper end of the yarn inlet tube 3. The snap ring 21 supports an intermediate sleeve 22, on which the inner ring of the bearing 17 rests. A flange ring, which is mounted on the upper end of the holding ring 18, is also supported on the inner ring of the bearing. An intermediate sleeve 24 having an inner annular shoulder is supported on the outer ring of the bearing 7. A snap ring 23 prevents the intermediate sleeve 24 being removed from the bearing 7. The intermediate sleeve has an outer truncated conical seat, on which a truncated conical seat on the upper part 17 of the slip-on member rests.

In the embodiment of FIG. 4, an intermediate sleeve 26, which surrounds the yarn inlet tube 3, is slipped onto the yarn inlet tube 3 and its inner annular shoulder rests on the upper end of the yarn inlet tube. The upper region of the intermediate sleeve 26 is provided with shoulder projections on the inside to support the bearing 7, which is secured inside the sleeve 26 by means of a snap ring 27. The inner ring of the bearing 7 is pulled over a further annular sleeve 30, which is prevented from being withdrawn axially from the bearing 7 by means of snap ring 29, a lower annular shoulder and an intermediate ring 28.

The upper part 17 of the slip-on member is provided with a central tube piece 12, which can be inserted into the bearing sleeve 30. The seats between the annular sleeve 30 and the central tube piece 12 are preferably provided with complementary conical surfaces in order to facilitate insertion of the slip-on member 15 into the annular sleeve 30.

In the embodiments shown in FIGS. 3 and 4, the complementary seats are preferably provided with complementary projections and/or recesses in order to prevent relative rotation between said seats.

In the drawings and specification, there have been set forth preferred embodiments of the invention, and although specific terms are employed, they are used in a generic and descriptive sense only and not for purposes of limitation.

I claim:

1. In a two-for-one textile yarn twisting machine spindle assembly including at least two supply packages of yarn mounted concentrically therein one above the other for simultaneous and separate withdrawal of yarns therefrom in a common direction, and a yarn inlet tube mounted concentrically with said yarn supply packages and having an upper end portion extending above said yarn supply packages for simultaneously receiving therein the yarns withdrawn from said supply packages; the improvement therein of a yarn brake mechanism for applying substantially uniform tension to the yarns moving from said supply packages to said yarn inlet tube without one yarn affecting the tension on the other yarn and comprising:

slip-on member means including bearing means for being rotatably mounted on said upper end portion of said yarn inlet tube for rotation relative thereto by frictional engagement of the yarns moving into said yarn inlet tube from said supply packages so that the rotational speed of said slip-on member means is commensurate with the rotational speed of the yarns, said slip-on member comprising a rotationally symmetrical member having a necked-down portion; and brake ring means for being floatingly received and mounted in said necked-down portion of said slip-on member means and for receiving the separate yarns between said brake ring means and said slip-on member means as the yarns move from said supply packages to said yarn inlet tube.

2. In a two-for-one twisting machine spindle assembly, as set forth in claim 1, in which said bearing means comprises ball bearing means having a rolling radius as small as possible.

3. In a two-for-one twisting machine spindle assembly, as set forth in claim 1, in which said bearing means comprises roller bearing means having a rolling radius as small as possible.

4. In a two-for-one twisting machine spindle, as set forth in claim 1, in which said bearing means comprises sliding bearing means.

5. In a two-for-one twisting machine spindle assembly, as set forth in claim 1, in which said brake mechanism further includes a holding ring positioned and mounted partially within said upper end portion of said yarn inlet tube and extending upwardly therefrom for receiving and mounting said bearing means on the upwardly extending portion thereof which in turn receives and mounts said slip-on member means which includes an annular shoulder for supporting said slip-on member means on said bearing means.

6. In a two-for-one twisting machine spindle assembly, as set forth in claim 1, in which said brake mechanism further includes a sleeve member mounted on the outside of said upper end portion of said yarn inlet tube and extending upwardly therefrom for receiving and said bearing means on the inside of the upwardly extending portion thereof, and in which said slip-on member means includes a central tube piece extending into said upper end portion of said yarn inlet tube and being mounted within said bearing means.

7. In a two-for-one twisting machine spindle assembly, as set forth in claim 1, in which said slip-on member means comprises two rotationally symmetircal parts axially detachable connected to each other.

8. In a two-for-one twisting meachine spindle assembly, as set forth in claim 7, in which said two parts include respective cooperating snap fastening means and in which one of said two parts comprises elastic material.

9. In a two-for-one twisting machine spindle assembly, as set forth in claim 7 or 8, in which the lower of said two parts comprises two annular portions of different diameters and a rounded shoulder portion connecting said two annular portions.

10. In a two-for-one twisting machine spindle assembly, as set forth in claim 8, in which said snap fastening means comprises a circumferential groove around the outside of the upper region of said annular portion having the smaller diameter, and a cooperating circumferential rib on the inside of the upper of said two parts of said slip-on member means.

11. In a two-for-one twisting machine spindle assembly, as set forth in claim 1, in which said brake mechanism further includes a sleeve member rotatably mounted on said yarn inlet tube and having conical shaped seat on the outer surface, and said slip-on member means includes a corresponding conical shaped seat on an inside surface thereof.

12. In a two-for-one twisting machine spindle assembly, as set forth in claim 1, in which said slip-on member means includes a portion above said necked-down portion in which the largest outer diameter is 10 to 20% larger than the inner diameter of said brake ring means.

13. In a two-for-one twisting machine spindle assembly, as set forth in claim 1, in which said brake ring means includes a yarn threading slot extending obliquely from the upper side to the lower side along the outside thereof.

14. In a two-for-one twisting machine spindle assembly, as set forth in claim 1, in which said brake ring means includes a V-shaped yarn threading slot extending along the outside thereof with the point of the V lying in the center plane of said brake ring means.

* * * * *